US006170608B1

(12) United States Patent
Gresser et al.

(10) Patent No.: US 6,170,608 B1
(45) Date of Patent: Jan. 9, 2001

(54) SCAFFOLD CONVEYOR SYSTEM

(75) Inventors: Michael J. Gresser; Mark Jerstad, both of Prior Lake; Keith E. Stieg, Maple Grove, all of MN (US)

(73) Assignee: Gressco of Collier County, Inc., Eagan, MN (US)

( * ) Notice: Under 35 U.S.C. 154(b), the term of this patent shall be extended for 0 days.

(21) Appl. No.: 09/204,664

(22) Filed: Dec. 2, 1998

(51) Int. Cl.[7] ..... E04G 1/18; E04G 3/10

(52) U.S. Cl. ..... 182/141; 193/35 R; 182/146

(58) Field of Search ..... 182/141, 148, 182/145, 146; 148/861.1; 52/31; 193/35 R, 35 TE

(56) References Cited

U.S. PATENT DOCUMENTS

| | | | | |
|---|---|---|---|---|
| 2,590,359 | * | 3/1952 | Zopf | 193/35 TE X |
| 2,613,788 | * | 10/1952 | McLaughlin | 193/35 TE |
| 2,846,275 | * | 8/1958 | Esch | 182/141 |
| 3,273,667 | | 9/1966 | Hiyama et al. | 182/129 |
| 3,311,191 | | 3/1967 | Hiyama | 182/131 |
| 3,529,696 | | 9/1970 | Jacobsen | 182/129 |
| 3,548,970 | | 12/1970 | Hutchens, Sr. | 182/129 |
| 3,717,220 | * | 2/1973 | Donker et al. | 193/35 R X |
| 3,777,357 | | 12/1973 | Whitney et al. | 29/249 |
| 4,056,180 | | 11/1977 | Gunti | 198/35 J |
| 4,172,677 | | 10/1979 | Gunti | 403/189 |
| 4,232,774 | | 11/1980 | Gunti | 193/35 J |
| 4,350,241 | | 9/1982 | Wenzel | 198/311 |
| 4,393,969 | * | 7/1983 | Woell | 193/35 TE |
| 4,443,148 | | 4/1984 | Arnemann | 414/139 |
| 4,607,574 | | 8/1986 | Richards | 104/126 |
| 4,715,488 | * | 12/1987 | Hewitt et al. | 193/35 R |
| 4,872,542 | | 10/1989 | Enneking | 198/312 |

OTHER PUBLICATIONS

Promotional material about Hydro–Mobile Scaffolding System downloaded from Internet Website of Avant–Garde Engineering (www.hydro–mobile.com) on Sep. 2, 1998.

* cited by examiner

*Primary Examiner*—Daniel P. Stodola
*Assistant Examiner*—Hugh B. Thompson
(74) *Attorney, Agent, or Firm*—Kinney & Lange

(57) ABSTRACT

A scaffolding system that includes a pair of tower portions, with each tower portion having a proximal section that is held in working relation with a bearing surface and each tower portion having a distal section, a platform, the platform supported by the distal section of each tower portion and the platform selectively movable both toward and away from the bearing surface, and a conveyor, the conveyor positioned on the platform between the pair of tower portions.

19 Claims, 5 Drawing Sheets

SCAFFOLD CONVEYOR SYSTEM

BACKGROUND OF THE INVENTION

The present invention generally relates to material handling on scaffolds. More specifically, the present invention relate, to a method of moving material by conveyor along a scaffolding platform that is capable of being raised and lowered with respect to a support surface, such as the ground.

Scaffolding systems are commonly used when maintaining, repairing, or building structural walls, such as masonry walls of buildings, and towers, such as radio or communications towers. On some types of scaffolding systems, the platform that carries the workers and any needed materials is capable of being selectively moved upward or downward, relative to the surface, such as the ground surface, that supports the scaffolding system. While these advances that permit more flexible placement of a platform with respect to the portion of the wall or tower being maintained or constructed are beneficial, further advances are necessary with respect to material handling techniques on these scaffolding platforms.

These scaffolding systems often have platforms that range in length up to 50 or 100 feet or more. Efficient material placement becomes increasingly critical as the length of these platforms increase. For example, when a fork lift places one stack of construction or maintenance materials on the scaffolding platform, workers must then distribute these materials at the required work positions along the length of the platform. This is inefficient from a labor standpoint because one or more workers may be assigned the single task of moving the materials by hand to the required work position. Besides being inefficient, this raises potential safety and health issues due to the requisite lifting and carrying activities on the work platform where walking space is usually at a premium.

Also, the amount of materials that can be positioned on these elongate platforms is limited by weight capacity limitations of the scaffolding systems. For example, though the individual support structures of these scaffolding systems sometimes have capacities of 15,000 pounds or more, the portions of the scaffolding platforms located between the support structures typically have capacities somewhat less than that of the platform proximate the support structure. Indeed, as the length of the platform increases, the capacity of the platform between the support structures typically decreases. Therefore, as the length of the platform increases, the need for more efficient material placement along the length of the platform likewise increases. These platform weight restrictions, especially the decreasing weight capacity of these platforms with increasing length, illustrate why it is not possible to simply create more individual stacks of materials along the length of the platform for purposes of more efficiently distributing the materials with respect to individual work stations on the platform.

Thus, a general need exists for a method of more efficiently placing construction and maintenance materials along the length of scaffolding platforms. This advance is needed to reduce safety and health issues arising from material placement on platforms and to reduce labor requirements during material placement. This advance is also needed to optimize use of the available weight capacities of scaffolding platforms, especially as platform lengths increase and weight-bearing capacities are reduced on the lengthened platforms.

BRIEF SUMMARY OF THE INVENTION

The present invention includes a method of positioning materials on a scaffolding system. The method includes supporting opposing ends of a platform on a pair of tower portions, where each tower portion is held in working relation with a ground surface and the platform is selectively movable both toward and away from ground surface. The method further includes positioning a conveyor on the platform, placing the materials on the conveyor, and operating the conveyor to selectively position the materials along the platform. The present invention further relates to a scaffolding system and other methods of positioning materials on the scaffolding system.

DETAILED DESCRIPTION

Figure 1:
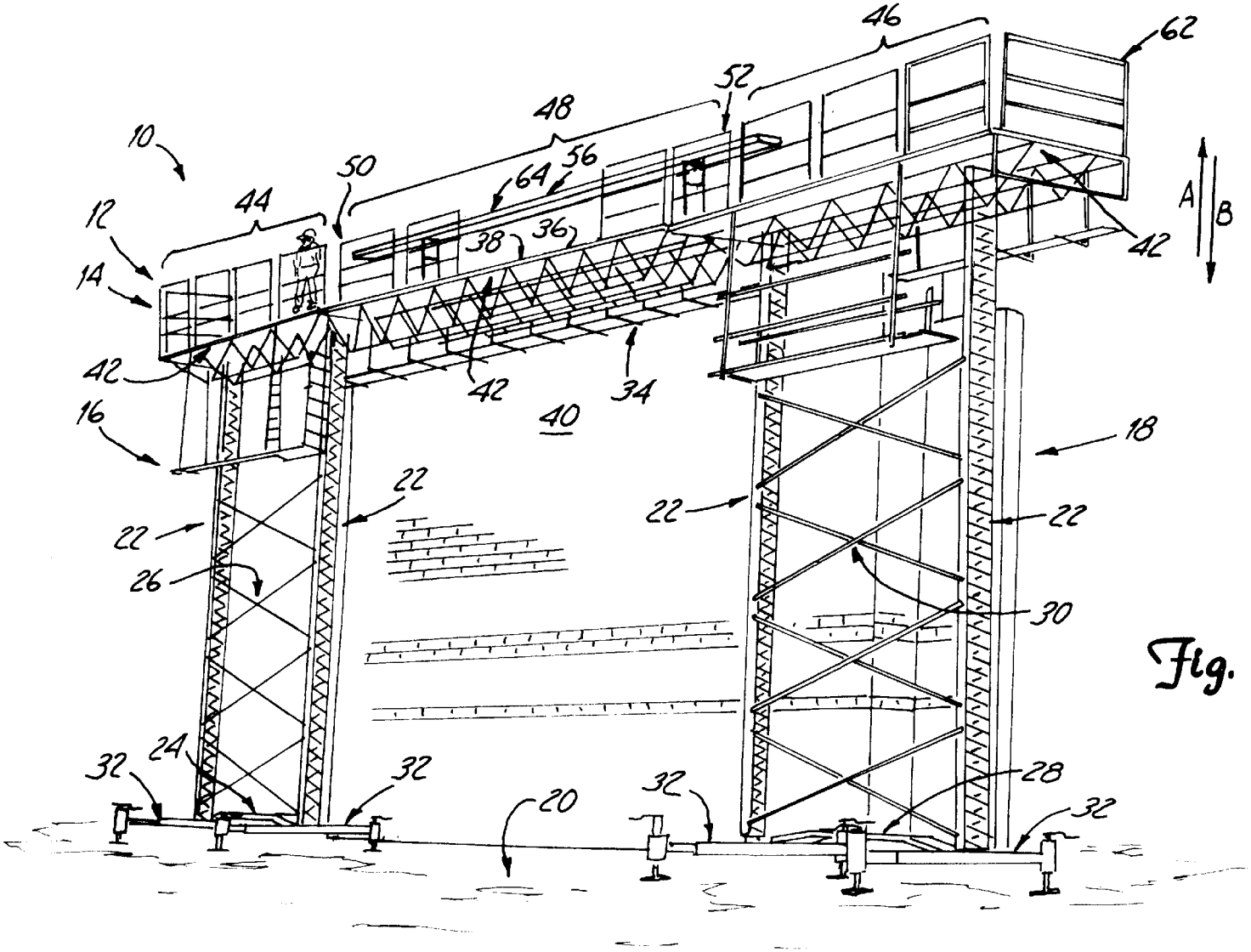
FIG. 1 is a perspective view of a conveyor mounted on a scaffold in accordance with the present invention.

A scaffolding and conveyor system of the present invention is generally depicted at 10 in FIG. 1. The system 10 includes a scaffold 12 having an elongate work platform 14 and a pair of supports, such as tower portions 16, 18. The supports, such as tower portions 16, 18, are securely positioned on a bearing surface, such as a ground surface 20, or a floor or foundation of a building or other structure. The tower portions 16, 18 are each free-standing and self supporting.

The tower portions 16, 18 may each include one or more legs 22. The legs 22 of the tower portion 16 are each secured to a frame 24 and are secured to each other by braces 26. Likewise, the legs 22 of the tower portion 18 are secured to a frame 28 and are secured to each other by braces 30. The supports, such as the tower portions 16, 18, are balanced and leveled with respect to the ground surface 20 using outriggers 32 that are attached to the frame 28.

The work platform 14 includes a planar frame (not shown) that is braced by ribbing 34. The work platform 14 also includes a covering web or layer 36. The layer 36 provides a planar surface 38 on which workers can walk and place materials and equipment while maintaining or building a structure, such as a wall 40, or other structure, such as a radio or communication, tower (not shown). The layer 36 may be constructed of any suitable web, sheeting, or planking 42 that is capable of providing the planar surface 38.

The platform 14 may consist of an end portion 44, an end portion 46 and a bridge portion 48. The end portion 44 is secured to the tower portion 16, and the end portion 46 is secured to the tower portion 18. The bridge portion 48 has a first end 50 and a second end 52. The first end 50 of the bridge portion 48 is releasably secured to the end portion 44 of the platform 14, and the second end 52 of the bridge portion 48 is releasably secured to the end portion 46 of the platform 14. Though, the tower portions 16, 18 are each free-standing and self supporting, the tower portions 16, 18, the platform 14, or any other component of the system 10 may be releasably attached to the wall 40 via a suitable brace (not shown) to further stabilize the system 10.

Figure 2:
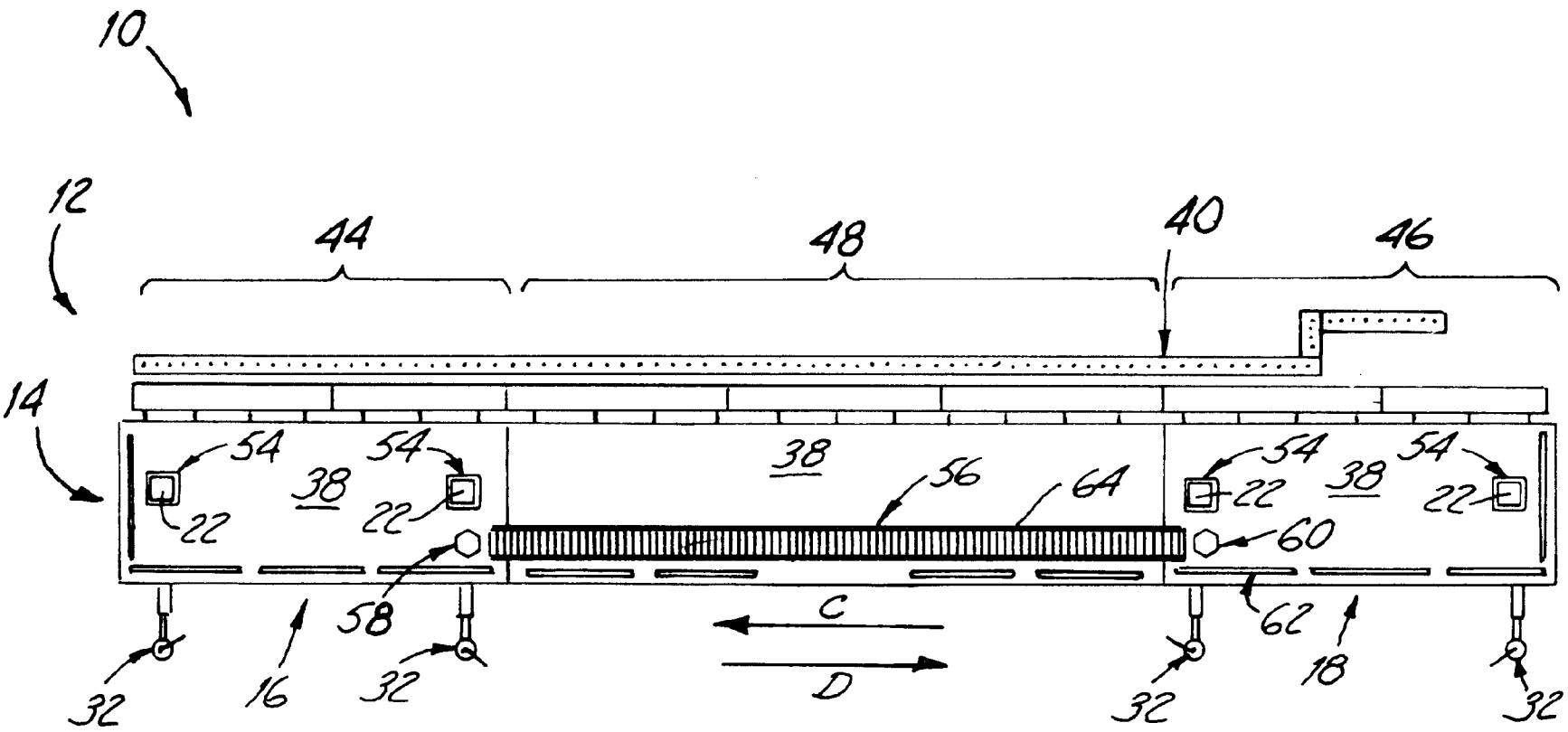
FIG. 2 is a top plan view of the conveyer and scaffold depicted in FIG. 1.

As best depicted in FIG. 2, a plurality of apertures 54 extend through the end portions 44, 46 of the work platform 14. The legs 22 of the tower portions 16, 18 extend through the apertures 54. The apertures 54 are sized to permit the work platform 14 to closely confront and engage each of the legs 22. The work platform 14 includes a plurality of drive mechanisms (not shown) proximate the apertures 54 that engage the legs 22. Returning to FIG. 1, the drive mechanisms, which may be electric, hydraulic, pneumatic, or manual, engage the legs 22 to permit selective movement of the platform 14 in the direction of arrow A away from the ground surface 20 or in the direction of arrow B toward the ground surface 20. The system 10 additionally includes a conveyor 56 that is positioned on the platform 14 for positioning materials from accumulations or stacks 58, 60 along the platform 14. The platform 14 also includes railings 62 that may be removed for purposes of accessing the platform 14 and placing materials on the platform 14.

One example of the scaffold 12 is available from Avant-Garde Engineering (1994) Inc., of L'Assomption (Quebec) Canada as the HYDRO-MOBILE brand of scaffolding. For example, Avant-Garde Engineering sells the tower sections 16, 18 with attached platform 14 end portions 44, 46 as individual units and also sells the bridge portion 48 of the platform 14 as an individual unit. The load capacity presently quoted by Avant-Garde Engineering for the tower portion 16 with the attached end portion 44 of the platform 14 is 15,000 lbs. The presently quoted load capacity for the tower portion 16 with the attached end portion 46 of the platform 14 is likewise 15,000 lbs. The load capacities for different lengths of the bridge portion 48 that are available from Avant-Garde Engineering are provided in Table 1 below:

TABLE 1

| BRIDGE SPECIFICATIONS | |
|---|---|
| LENGTH | CAPACITY |
| 12' | 12,400 lbs. |
| 28' | 10,900 lbs. |
| 36' | 10,100 lbs. |
| 48' | 8,500 lbs. |
| 56' | 7,700 lbs. |

The details provided in Table 1 illustrate that the load bearing capacity of the bridge portion 48 available from Avant-Garde Engineering decreases as the length of the bridge portion 48 increases.

Typically, the tower portions 16, 18 of the scaffold 12 will have higher load capacities than the bridge portion 48 of the platform 14. Therefore, though the stack 58 and the conveyor 56 could both be positioned on the bridge portion 48, the stack 58 is preferably positioned on the end portion 44 of the platform 14 to take full advantage of the distribution potential of the conveyor 56 while minimizing loading of the bridge portion 48.

The conveyor 56 is preferably capable of reverse operation in the direction of either arrow C or arrow D. This reversible capability of the conveyor 56 permits placement of the accumulation or stack 60 of material on the end portion 46 proximate the tower portion 18, in addition to placement of the accumulation or stack 58. This reversible capability of the conveyor 56 maximizes the amount of a single material that can be stockpiled in the accumulations or stacks 58, 60 on the scaffold 12. Alternatively, this reversible capability of the conveyor 56 permits the conveyor 56 to serve the dual purpose of distributing one material from the stack 58 along the platform 14 and a different material from the stack 60 along the platform 14.

Figure 3:
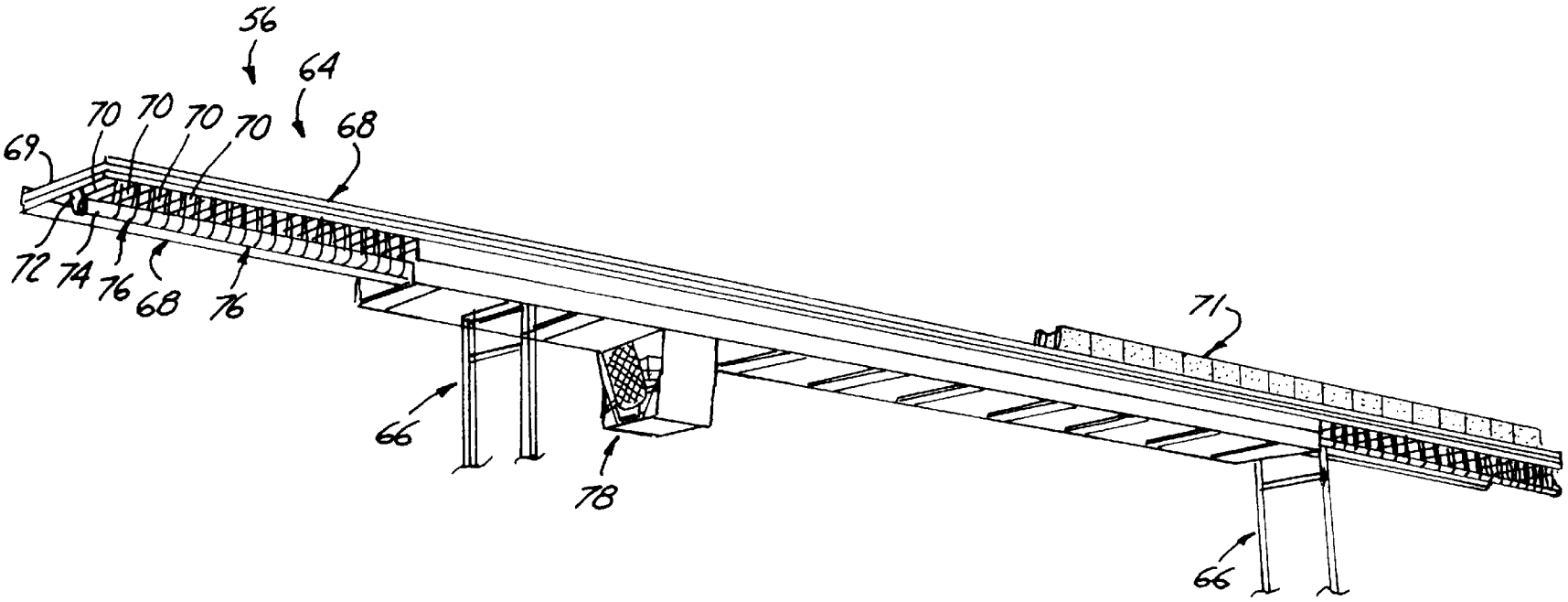
FIG. 3 is a perspective view of the conveyor depicted in FIG. 1.
Figure 4:
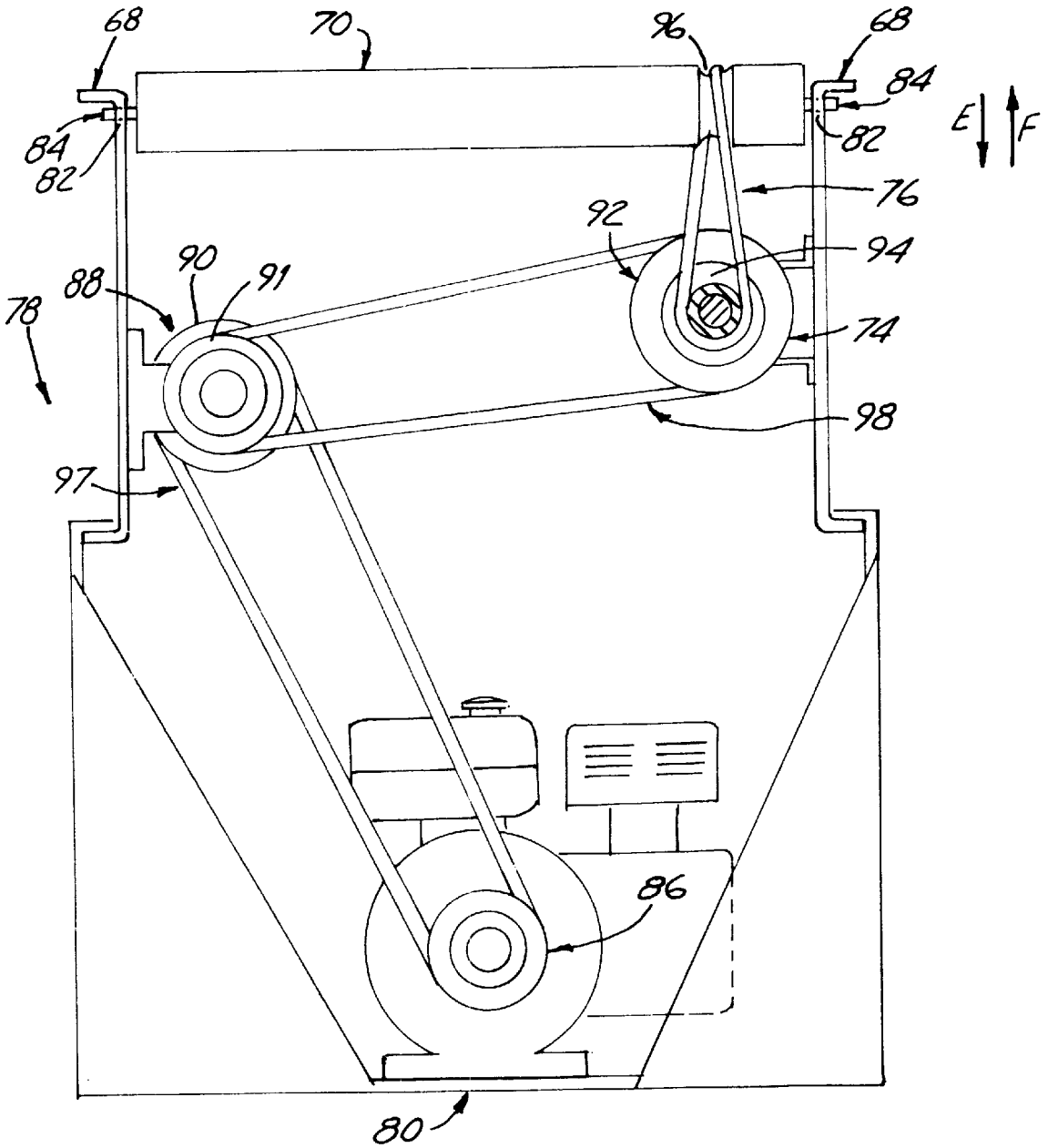
FIG. 4 is a side plan view of a portion of the conveyor depicted in FIG. 3.

The roller conveyor 64 includes a pair of stands 66, as best depicted in FIG. 3, that support the conveyor 64 on the planar surface 38 (not shown in FIG. 3) of the work platform 14 (not shown in FIG. 3). The conveyor 64 also includes a pair of elongate opposing frame members 68 and a pair of end frame members 69 (only one of the end frame members 69 is shown in FIG. 4). The conveyor 64 includes a plurality of rollers 70 that are rotatably held between the opposing elongate frame members 68. Construction or maintenance materials, such as concrete blocks 71, are placed on the rollers 70 for selective positioning along the platform 14 by the conveyor 64.

The conveyor 64 additionally includes a pair of thrust bearings 72 (only one thrust bearing 72 is shown in FIG. 3) that are secured to the end frame members 69. The conveyor 64 further includes an elongate cylindrical drive member 74 that is rotatably held between the thrust bearings 72 and may be additionally supported by other bearings (not shown) that are secured to the frame of the conveyor 64. A plurality of cylindrical cross-section drive belts 76 connect the drive member 74 to the individual rollers 70. The conveyor 64 includes a power supply and control mechanism 78 that drives the elongate cylindrical drive member 74 and consequently also drives the rollers 70.

Though not depicted, the end frame members 69 may extend above the rollers 70 and thereby form a stop. The stop coupled with slippage of the rotating rollers 70 beneath the construction or maintenance materials, such as the concrete blocks 71, permits continuous operation of the mechanism 78. As concrete blocks 71 are removed from the conveyor 64, additional concrete blocks 71 move along the conveyor 64 to replenish the withdrawn concrete blocks 71.

As best depicted in FIG. 4, a plurality of apertures 82 are included in the frame members 68. The rollers 70 each have a pair of pins 84 that fit within opposing apertures 82 and permit rotation of the rollers 70. The pins 84 are spring-loaded to permit depression of the pins 84 into the rollers 70 and removal or replacement of the rollers 70.

The power supply and control mechanism 78 of the conveyor 64 includes a motor, such as an electric or gasoline-powered motor 80. The motor 80 includes a drive pulley 86. The power supply and control mechanism 78 additionally includes a translation gear 88 that is rotatably held by and between two thrust bearings (not shown) that are attached to one of the frame members 68. The translation gear 88 includes a pair of pulleys 90, 91. The radii of the pulleys 90, 91 may be sized differently to increase or decrease the rotational speed of the rollers 70 relative to the rotational speed of the pulley 86.

The elongate cylindrical drive member 74 includes a radial recess 92 and a plurality of radial recesses 94. Additionally, the rollers 70 each include a radial recess 96. The radii of the pulley 90 and of the radial recess 92 may be sized differently to increase or decrease the rotational speed of the rollers 70 relative to the rotational speed of the pulley 86. Likewise, the radii of the recesses 92, 94 may be sized differently to increase or decrease the rotational speed of the rollers 70 relative to the rotational speed of the pulley 86.

The pulley 86 is attached to the pulley 90 of the translation gear 88 by a belt 97 and the pulley 91 of the translation gear 88 is attached to the elongate cylindrical drive member 74 by a belt 98 which is positioned within the recess 92 of the drive member 74. Also, each roller 70 is individually attached to the drive member 74 by one of the belts 76 that is positioned in the recess 96 of the roller 70 and in the nearest recess 94 to the particular roller 70.

In operation, the power supply, such as th(motor 80, is activated to drive the elongate cylindrical drive member 74 which then drives each of the rollers 70 via the various belts 76 that are individually connected to the individual rollers 70. As an alternative, the motor 80 may consist of a power supply, such as a reversible direct current electric motor (not shown), that is connected to a source of electric power. The reversible motor permits the power supply and control mechanism 78 to drive the rollers 70 radially in either a direction E or a reverse direction F and thereby permits the conveyor 64 to transport materials either in the direction of the arrow C or in the direction of arrow D, as best depicted in FIG. 2.

Figure 5:
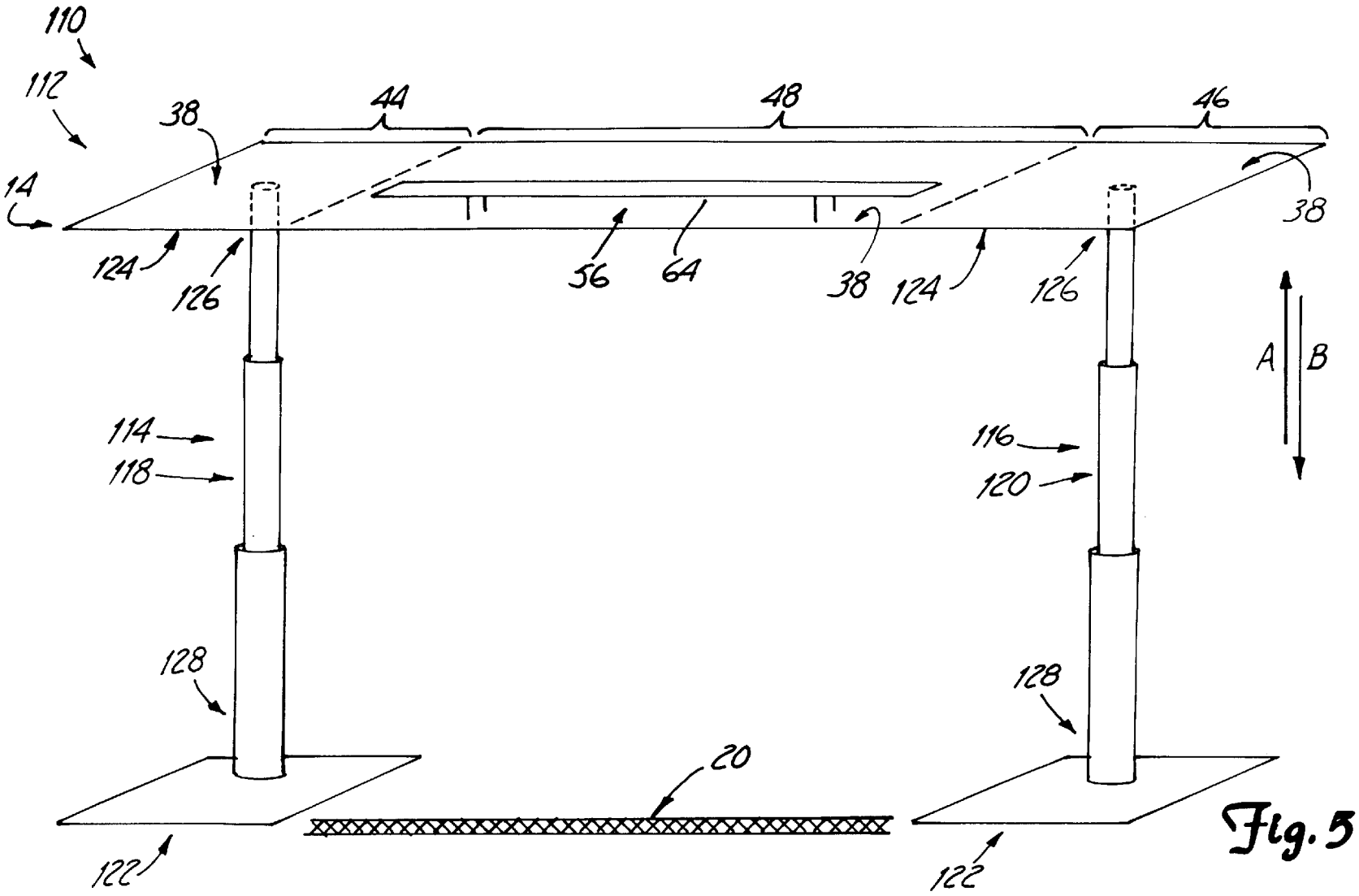
FIG. 5 is a perspective view of a conveyor mounted on another scaffold in accordance with the present invention.

As an alternative to the scaffolding and conveyor system 10, the present invention may take the form of a scaffolding and conveyor system 110, as best depicted in FIG. 5. The scaffolding and conveyor system 110 includes the work platform 14 having the end portions 44, 46 and the bridge portion 48. The system 110 additionally includes a scaffold 112 with extendable supports 114, 116. The extendable supports 114, 116 may take the form of any extendable boom, tower or similar structure that is conventionally available. For example, the extendable supports 114, 116 may constitute telescoping masts or booms 118, 120 that are secured relative to the bearing surface, such as the ground surface 20, in any conventional fashion, such as via base plates 122.

In the system 110, the work platform 14 has a bottom surface 124. The supports 114, 116 each have a distal end 126 and a proximal end 128. The proximal end 128 of each support 114, 116, is stabilized with respect to the bearing surface, such as the ground surface 20, by the base plates 122. The distal ends 126 of each support 114, 116 are attached to the bottom surface 124 of the work platform 14 at the end portions 44, 46, respectively. The extendable supports 114, 116 may be extended or retracted using any suitable source of power, such as hydraulic, electric, pneumatic or mechanical power, to move the work platform 14 either away from the surface 20 in the direction of arrow A or towards the surface 20 in the direction of arrow B.

The system 10 of FIG. 2 offers various flexibilities as compared to the prior technique of manually positioning materials along the work platform 14. In operation, materials from the accumulation or stack 58 are positioned on the conveyor 64. The power supply and control mechanism 78 is then activated to turn the rollers 70 and permit movement of the materials from the stack 58 along the conveyor 64 in the direction of arrow D until the materials reach a desired work position along the platform 14. Then, the materials are lifted off of the conveyor 64 and placed at the desired work position on the platform 14. Alternatively, materials from the accumulation or stack 60 may be positioned on the conveyor 64 and moved in the direction of arrow C to the desired work position along the platform 14. Also, as mentioned, the mechanism 78 may be continuously operated when employing the described stop to continuously replenish materials that are removed from the conveyor 64.

Additionally, either before, during, or after positioning of materials along the platform 14 using the conveyor 64, the work platform 14 may be selectively moved in the direction of arrow A away from the ground surface 20 or in the direction of arrow B toward the ground surface 20, as depicted in FIG. 1. The movement of the platform 14 may be accomplished by engaging the drive mechanisms (not shown) of the platform 14 with the legs 22 of the structural supports 16, 18. Alternatively, the movement of the platform 14 may be accomplished by extending or retracting the extendable supports 114, 116, such as the telescoping booms 118, 120, as depicted in FIG. 5.

The system 10 that includes the conveyor 56 permits support of the stacks 58, 60 of materials on the tower portions 16, 18 that typically have the highest load bearing capacity, as compared to the load bearing capacity of the bridge portion 48 of the platform 14. Additionally, placement of the materials from the stacks 58, 60 onto the conveyor 56 and subsequent operation of the conveyor 56 to transport the materials to the desired position along the platform 14 reduces the labor requirement and reduces the amount of lifting and carrying of materials by material transfer personnel.

Typically, use of the conveyor 56 requires only one operator to both load the materials onto the conveyor 56 and to operate the conveyor 56 for positioning of the materials at the desired position(s) along the platform 14. The conveyor 56 additionally negates any need of creating multiple piles of space along the work platform 14 proximate the various work stations., thereby reducing clutter on the work platform 14. Additionally, due to the ease and increased speed of positioning materials along the platform 14, such as along the bridge portion 48, and with transferring materials between the end portions 44 and 46, the system 10 decreases the weight of materials that must be present on the bridge portion 48 at any one time. The system 10 thereby supports efficient maintenance or construction work on the wall 40 and also permits use of longer bridge sections 48 with lower load bearing capacities than would otherwise be attainable without use of the conveyor 56.

Analogous comments to those provided above with respect to the benefits of the system 10 of FIG. 2 apply with respect to the system 110 of FIG. 5.

Although the present invention has been described with reference to preferred embodiments, workers skilled in the art will recognize that changes may be made in form and detail without departing from the spirit and scope of the invention.

What is claimed is:

1. A scaffolding system, the scaffolding system comprising:

a pair of tower portions, each tower portion having a proximal section that is capable of being held in working relation with a bearing surface and each tower portion having a distal section, at least one of the tower portions comprising a leg;

a platform, the platform comprising an upper surface, a lower surface, and an inner surface, the inner surface defining an aperture that extends from the upper surface of the platform to the lower surface of the platform, the leg extending through the aperture of the platform, the platform supported by the distal section of each tower portion, and the platform selectively movable both toward and away from the bearing surface; and a conveyor, the conveyor positioned on the platform between the pair of tower portions.

2. The scaffolding system of claim 1 wherein the platform comprises a pair of end portions, one end portion secured to one of the tower portions and the other end portion secured to the other tower portion; and a bridge portion, the bridge portion having a distal end and proximal end, the distal end releasably attached to one of the end portions and the proximal end releasably attached to the other end portion.

3. The scaffolding system of claim 2 wherein the conveyor is positioned on the bridge portion of the platform between the end portions of the platform.

4. The scaffolding system of claim 2 wherein the tower portions are each free standing and self supporting.

5. The scaffolding system of claim 1 wherein the platform comprises a planar surface, the conveyor entirely supported by the planar surface.

6. The scaffolding system of claim 1 wherein:

the platform comprises a planar surface;

the planar surface has a first length and a first width;

the conveyor has a second length and a second width;

the first length is greater than the second length; and the first width is greater than the second width.

7. The scaffolding system of claim 1 wherein:

the platform comprises a planar surface;

the planar surface has a first footprint;

the conveyor has a second footprint;

the first footprint and the second footprint are oriented substantially parallel to each other; and the first footprint of the planar surface is greater than the second footprint of the conveyor.

8. The scaffolding system of claim 1 wherein the scaffolding system is positionable on the bearing surface with the platform oriented substantially parallel to the bearing surface and with the platform entirely located between the conveyor and the bearing surface.

9. A method of positioning materials on a scaffolding system, the method comprising:

supporting two opposing ends of a platform on a pair of tower portions, at least one of the tower portions comprising a leg, the platform comprising an upper surface, a lower surface, and an inner surface, the inner surface defining an aperture that extends from the upper surface of the platform to the lower surface of the platform, the log extending through the aperture of the platform, and each tower portion held in working relation with a bearing surface;

selectively moving the platform along the leg;

positioning a conveyor on the platform;

placing the materials on the conveyor; and operating the conveyor to selectively position the materials along the platform.

10. The method of claim 9, the method further comprising positioning the conveyor on the platform between the pair of tower portions.

11. The method of claim 9 wherein operating the conveyor comprises selectively positioning the materials along the platform between the pair of tower portions.

12. The method of claim 9 wherein the bearing surface is a ground surface.

13. The method of claim 9 wherein the platform comprises a pair of end portions and a bridge portion, the method further comprising:

securing one end portion to one of the tower portions;

securing the other end portion to the other tower portion;

releasably attaching a distal end of the bridge portion to one of the end portions;

releasably attaching a proximal end of the bridge portion to the other end portion.

14. The method of claim 13 the method further comprising positioning the conveyor on the bridge portion of the platform between the end portions of the platform.

15. The method of claim 9 wherein the tower portions are each free standing and self supporting.

16. The method of claim 9 wherein the platform comprises a planar surface, the conveyor entirely supported by the planar surface.

17. The method of claim 9 wherein:

the platform comprises a planar surface;

the planar surface has a first length and a first width;

the conveyor has a second length and a second width;

the first length is greater than the second length; and the first width is greater than the second width.

18. The method of claim 9 wherein:

the platform comprises a planar surface;

the planar surface has a first footprint;

the conveyor has a second footprint;

the first footprint and the second footprint are oriented substantially parallel to each other; and the first footprint of the planar surface is greater than the second footprint of the conveyor.

19. The method of claim 9 wherein the scaffolding system is positionable on the bearing surface with the platform oriented substantially parallel to the bearing surface and with the platform entirely located between the conveyor and the bearing surface.

* * * * *